US008007202B2

(12) United States Patent
Davis et al.

(10) Patent No.: US 8,007,202 B2
(45) Date of Patent: Aug. 30, 2011

(54) PROTECTIVE MARINE BARRIER SYSTEM

(75) Inventors: Gregory A. Davis, Mechanicsville, VA (US); Barbara M. Costain, Richmond, VA (US); Carolyn S. Westmark, Richmond, VA (US); Ashok Bhatnagar, Richmond, VA (US)

(73) Assignee: Honeywell International, Inc., Morristown, NJ (US)

( * ) Notice: Subject to any disclaimer, the term of this patent is extended or adjusted under 35 U.S.C. 154(b) by 1054 days.

(21) Appl. No.: 11/497,843

(22) Filed: Aug. 2, 2006

(65) Prior Publication Data

US 2010/0239374 A1 Sep. 23, 2010

(51) Int. Cl.
*B06G 9/04* (2006.01)
*E02B 15/06* (2006.01)

(52) U.S. Cl. ..... 405/63; 405/26; 405/219; 114/263; 114/264; 114/267; 52/309.4

(58) Field of Classification Search ..... 114/263–267, 114/44, 258; 405/219, 26, 63–72, 224; 264/228, 264/256, 33; 106/99; 52/309.17, 309.1, 52/309.4, 309.7; 14/27; 441/65
See application file for complete search history.

(56) References Cited

U.S. PATENT DOCUMENTS

| | | | | | |
|---|---|---|---|---|---|
| 2,892,433 | A | * | 6/1959 | Walker | 114/266 |
| 3,448,709 | A | * | 6/1969 | Hardwick, Jr. | 114/266 |
| 3,546,773 | A | * | 12/1970 | Gerstin | 29/433 |
| 3,671,542 | A | | 6/1972 | Kwolek et al. | 524/157 |
| 3,708,982 | A | * | 1/1973 | Blockwick | 405/70 |
| 3,975,487 | A | | 8/1976 | Cottis et al. | 264/210.6 |
| 4,118,372 | A | | 10/1978 | Schaefen | 528/190 |
| 4,137,394 | A | | 1/1979 | Meihuizen et al. | 528/100 |
| 4,161,470 | A | | 7/1979 | Calundann | 524/599 |
| 4,260,285 | A | * | 4/1981 | Kurihara et al. | 405/68 |
| 4,270,874 | A | * | 6/1981 | March et al. | 405/63 |
| 4,332,048 | A | * | 6/1982 | Eddy | 441/1 |
| 4,356,138 | A | | 10/1982 | Kavesh et al. | 264/164 |
| 4,413,110 | A | | 11/1983 | Kavesh et al. | 526/348.1 |
| 4,430,383 | A | | 2/1984 | Smith et al. | 428/364 |
| 4,436,689 | A | | 3/1984 | Smith et al. | 264/204 |
| 4,440,711 | A | | 4/1984 | Kwon et al. | 264/185 |
| 4,457,985 | A | | 7/1984 | Harpell et al. | 428/224 |
| 4,535,027 | A | | 8/1985 | Kobashi et al. | 428/364 |
| 4,536,536 | A | | 8/1985 | Kavesh et al. | 524/462 |

(Continued)

FOREIGN PATENT DOCUMENTS

FR 2798729 3/2001

(Continued)

OTHER PUBLICATIONS

"Talking Tech—Textile Effects", CIBA Specialty Chemicals, 2005, XP002489113.

*Primary Examiner* — Jeanette E. Chapman

(57) ABSTRACT

A system to protect structures in a marine environment from the effects of an impact force. The system includes a plurality of floatable devices (panels) and a plurality of fibrous networks. The fibrous networks include high tenacity fibers which extend at least in a generally horizontal direction and are in communication with the plurality of floatable panels. The plurality of fibrous networks are disposed in a generally parallel arrangement with respect to each other and are vertically spaced apart by a distance not exceeding about 12 inches (30.5 cm). The system is designed to be spaced from the structure to be protected.

37 Claims, 3 Drawing Sheets

U.S. PATENT DOCUMENTS

| | | | | | |
|---|---|---|---|---|---|
| 4,545,950 | A | | 10/1985 | Motooka et al. | 264/210.6 |
| 4,551,296 | A | | 11/1985 | Kavesh et al. | 264/203 |
| 4,599,267 | A | | 7/1986 | Kwon et al. | 428/364 |
| 4,612,148 | A | | 9/1986 | Motooka et al. | 264/49 |
| 4,617,233 | A | | 10/1986 | Ohta et al. | 428/364 |
| 4,663,101 | A | | 5/1987 | Kavesh et al. | 264/178 F |
| 5,032,338 | A | | 7/1991 | Weedon et al. | 264/203 |
| 5,102,261 | A | * | 4/1992 | Gunderson, III | 405/70 |
| 5,107,785 | A | * | 4/1992 | Baxter | 114/266 |
| 5,246,657 | A | | 9/1993 | Yagi et al. | 264/210.6 |
| 5,286,435 | A | | 2/1994 | Slukster et al. | 264/205 |
| 5,286,833 | A | | 2/1994 | Bubeck et al. | 528/183 |
| 5,296,185 | A | | 3/1994 | Chau et al. | 264/205 |
| 5,342,567 | A | | 8/1994 | Chen et al. | 264/203 |
| 5,356,584 | A | | 10/1994 | Bubeck et al. | 264/205 |
| 5,534,205 | A | | 7/1996 | Faley et al. | 264/103 |
| 5,578,374 | A | | 11/1996 | Dunbar et al. | 428/364 |
| 5,674,969 | A | | 10/1997 | Sikkema et al. | 528/183 |
| 5,702,657 | A | | 12/1997 | Yoshida et al. | 264/112 |
| 5,736,244 | A | | 4/1998 | Kavesh et al. | 428/364 |
| 5,741,451 | A | | 4/1998 | Dunbar et al. | 264/103 |
| 5,901,632 | A | | 5/1999 | Ryan | 87/13 |
| 5,931,076 | A | | 8/1999 | Ryan | 87/8 |
| 5,939,553 | A | | 8/1999 | Reichwein et al. | 546/250 |
| 5,945,537 | A | | 8/1999 | Sikkema | 546/307 |
| 5,958,582 | A | | 9/1999 | Dunbar et al. | 428/364 |
| 5,972,498 | A | | 10/1999 | Kavesh et al. | 428/364 |
| 6,040,050 | A | | 3/2000 | Kitagawa et al. | 428/364 |
| 6,040,478 | A | | 3/2000 | Sikkema et al. | 562/424 |
| 6,448,359 | B1 | | 9/2002 | Kavesh | 526/352 |
| 6,642,159 | B1 | | 11/2003 | Bhatnagar et al. | 442/134 |
| 6,681,709 | B1 | | 1/2004 | Nixon et al. | |
| 6,945,153 | B2 | | 9/2005 | Knudsen et al. | 87/1 |
| 6,969,553 | B1 | | 11/2005 | Tam et al. | 428/364 |
| 2003/0051652 | A1 | | 3/2003 | Metherell et al. | |
| 2005/0013668 | A1 | | 1/2005 | Nixon et al. | 405/218 |
| 2005/0093200 | A1 | | 5/2005 | Tam et al. | 264/211.4 |
| 2006/0192189 | A1 | * | 8/2006 | Uyanik | 256/23 |

FOREIGN PATENT DOCUMENTS

| | | |
|---|---|---|
| WO | WO2005/059275 | 6/2005 |

* cited by examiner

PROTECTIVE MARINE BARRIER SYSTEM

BACKGROUND OF THE INVENTION

1. Field of the Invention

This invention relates to protective barriers to protect structures such as vessels, docks and harbors in a marine environment from damage.

2. Description of the Related Art

Ships and similar marine structures are vulnerable to attack by watercraft, such as small watercraft that is laden with explosives, other munitions or other threatening materials. Ships such as military vessels and commercial vessels are vulnerable to such threats, especially when they are docked at a port or the like. Likewise, docks, ports and harbors, and their component structures, as well as power plants and the like, are potentially subject to similar threats.

Various systems have been proposed to protect ships from such waterborne threats. Examples include a steel mesh netting barrier as disclosed in U.S. publication 2005/0013668 to Nixon et al., and a security barrier system based on wave attenuating structures as disclosed in PCT publication WO 2005/059275.

A need still exists to provide protective barrier systems for use in marine environments that are lightweight and are easy to deploy. Desirably, such barrier systems also are unaffected by either fresh or salt water. These systems should be able to dissipate an impact force such that a threatening watercraft could be prevented from reaching a position which is close to the structure to be protected, so as to minimize damage to the structure.

Accordingly, it would be desirable to provide a protective marine barrier system which was lightweight and easy to deploy. Such barrier system would desirably be easy to manufacture and not complex in design.

SUMMARY OF THE INVENTION

In accordance with this invention, there is provided a system to protect structures in a marine environment from the effects of an impact force, the system comprising:

(a) a plurality of floatable panels, the panels being adapted to be located at a distance from the structure to be protected; and (b) a plurality of fibrous networks, the fibrous networks comprising high tenacity fibers extending in at least a generally horizontal direction, the plurality of fibrous networks being in communication with the plurality of floatable panels and interconnecting the plurality of floating panels, the plurality of fibrous networks being disposed in a generally parallel arrangement with respect to each other along the generally horizontal direction in a generally vertical plane, the plurality of fibrous networks being vertically spaced apart by a distance not exceeding about 12 inches (30.5 cm).

Also in accordance with this invention, there is provided in a system to protect structures in a marine environment from the effects of an impact force, the improvement comprising:

(a) a plurality of floatable panels, the panels being adapted to be located at a distance from the structure to be protected; and (b) a plurality of fibrous networks, the fibrous networks comprising high tenacity fibers extending in at least a generally horizontal direction, the plurality of fibrous networks being in communication with the plurality of floatable panels and interconnecting the plurality of floating panels, the plurality of fibrous networks being disposed in a generally parallel arrangement with respect to each other along the generally horizontal direction in a generally vertical plane, the plurality of fibrous networks being vertically spaced apart by a distance not exceeding about 12 inches (30.5 cm).

Further in accordance with this invention, there is provided a system to protect structures in a marine environment from the effects of an impact force, the system comprising:

(a) a plurality of interconnected floatable panels, the panels being adapted to be located at a distance from the structure to be protected; the plurality of floatable panels comprising end units;

(b) a plurality of fibrous networks, the fibrous networks comprising high tenacity fibers extending in a least a generally horizontal direction, the plurality of fibrous networks being in communication with the plurality of floatable panels and interconnecting the plurality of floating panels, the plurality of fibrous networks being disposed in a generally parallel arrangement with respect to each other along the generally horizontal direction in a generally vertical plane, the plurality of fibrous networks being vertically spaced apart by a distance not exceeding about 12 inches (30.5 cm); and (c) means for attaching at least the end units of the plurality of floatable panels to anchor means for fixing at least the end units in a desired position.

It has been discovered that by using high tenacity fibrous networks in conjunction with floatable panels, with the fibrous networks being positioned in generally close proximity to each other, the fibrous networks are capable of acting in a combined manner to withstand the impact force of an intruding vessel. As a result, the marine structures can be protected in a relatively simple manner.

The floatable panels themselves need not be designed to have any significant impact resistance. Rather, they are designed to act as a mechanism to position the plurality of fibrous networks, and fibrous networks of high tenacity fibers form the necessary impact barrier to the impact force.

BRIEF DESCRIPTION OF THE DRAWINGS

This invention will become more fully understood and further advantages will become apparent when reference is had to the following detailed description of the preferred embodiments of the invention and the accompanying drawings, in which.

DETAILED DESCRIPTION OF THE INVENTION

Figure 1:
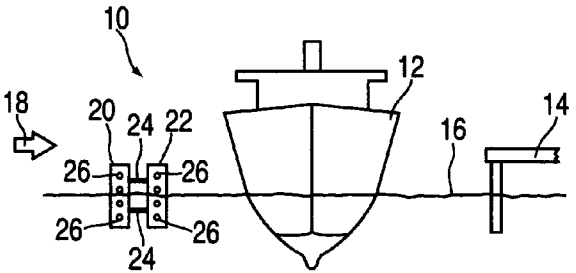
FIG. 1 is a schematic illustration of the protective barrier system of this invention.

With reference to the drawings, like numerals depict like elements, and it should be pointed out that the drawings are not to scale. FIG. 1 shows a protective system 10 which is designed to protect a structure, shown here as vessel 12 which is docked at a dock 14 by suitable means not shown. It is to be understood that the structure to be protected by the system of this invention is not limited to a boat or ship, but may be a dock, a port, marina, a facility in a port or harbor, shipyard, boatyard, dam, land structure adjacent to water such as a power plant, and the like. Vessel 12 is shown in water, with the waterline depicted by numeral 16. The body of water may be any body, such as an ocean, bay, river, lake, etc.

System 10 is designed to provide a protective barrier against threats (not shown) which are schematically illustrated as coming from the direction of arrow 18. Such threats may be from, for example, light watercraft that are laden with explosives or other harmful or destructive materials, as well as intruders, divers and the like.

System 10 includes a plurality of floatable panels or modules 20 which are positioned in the water at a predetermined distance from vessel 12, and are floating with respect to waterline 16. Panels 20 may be of any desired shape or form, although a generally rectangular form is preferred as shown in the figures. Panels 20 may be formed of any suitable material which is floatable or can be made floatable by inserts and the like. Preferably, panels 20 are formed from a plastic material, such as polyethylene (e.g., high density polyethylene, or linear low density polyethylene) or the like. These panels are preferably lightweight, thus making them easy to deploy around vessel 12 or other structure to be protected. The panels may extend a desired amount above and below the surface of the water. Panels 20 may be molded in a one-piece construction, with a hollow interior, or they may be in the form of a solid block of material. The panels may be of any desired color or surface finish.

The spacing of panels 20 from vessel 12 may vary depending on such factors as the threat level to be protected against, the strength of the system, and the like. The spacing may readily be determined by one skilled in the art. The panels 20 should be spaced a minimum distance so that system 10 can protect vessel 12 from an impact force resulting from an intruding boat or the like. On the other hand, if panels 20 were spaced very far from vessel 12 then the overall protective area would be very large, resulting in a very high cost for the system, and which may also impede the flow of marine traffic. As an example, panels 10 may be spaced from vessel 12 at a distance of at least about 10 feet (3 meters), up to a distance of about 1000 to about 2000 feet (300 to 600 meters) from vessel 12.

Figure 6:
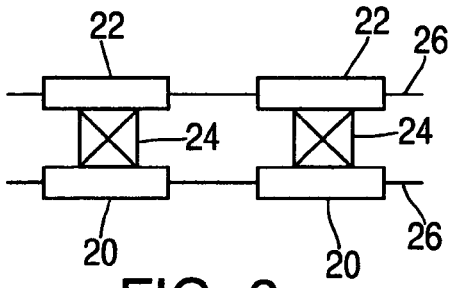
FIG. 6 is a plan view of two interconnected devices of the invention.

Although panels 20 may be of a single monolithic structure, alternatively they may be in the form of two units (front panel 20 and rear panel 22 in FIGS. 1 and 6) that are fixedly attached to each other by means of crosspieces or connectors 24 (of any desired shape) or the like. Front panel 20 is designed to face outwardly from vessel 12 and towards the direction of the possible threat. The outer faces of the panels may be provided with wave attenuating features, such as openings and protuberances (not shown). One type of panel is that disclosed in the aforementioned PCT publication WO 2005/059275, the disclosure of which is expressly incorporated herein by reference to the extent it is not inconsistent herewith. Each of the panels 20, 22 may be integrally molded, and connectors 24 may be molded integral with one or both panels 20, 22.

In one embodiment of the invention, panels 20 are provided with a plurality of openings 36 which extend through the sides of the panel. If panels 20 have a hollow interior, then openings 36 communicate with the hollow interior. Alternatively, if panels 20 are formed from a solid structure, then openings 36 preferably extend through the entire width of panels 20. See, for example, FIGS. 4 and 5. Positioned through openings 36 are a plurality of ropes or cables 26 as more fully described below. Ropes 26 serve to interconnect panels 20 with one another and two such adjacent panels are shown in FIG. 4.

Figure 2:
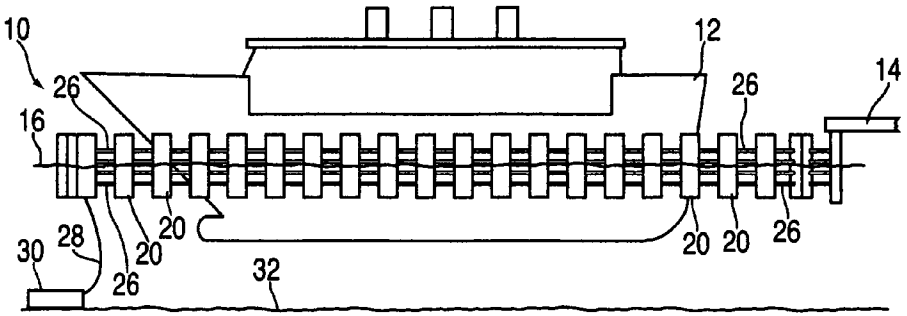
FIG. 2 is a side schematic illustration of the protective barrier system of this invention.
Figure 3:
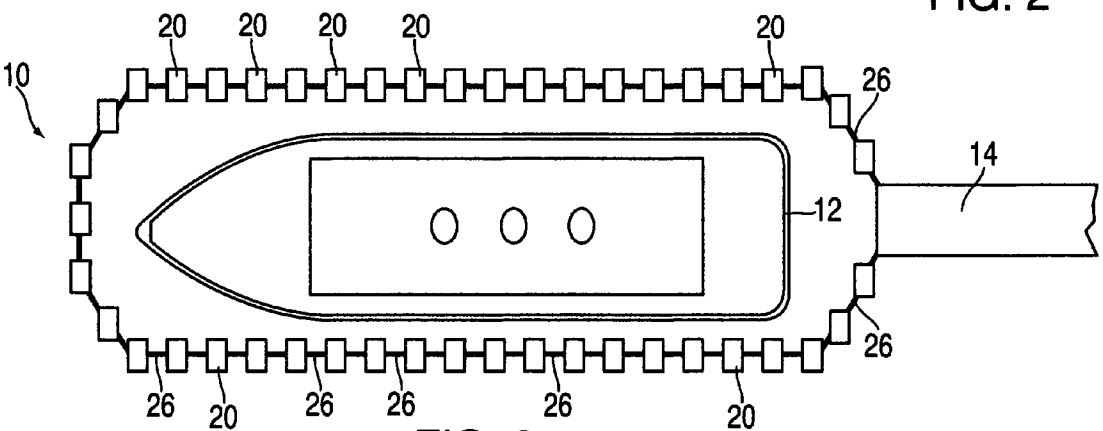
FIG. 3 is a plan schematic view of the protective barrier system of this invention.

As depicted in FIG. 2, one (or more) of panels 20 may be connected to the seabed 32 by means of a mooring line 28 attached to an anchor 30 in any suitable manner. Mooring line 28 may be formed from any desired material, such as catenary steel chain moorings, large nylon or polyester moorings, high modulus materials such as extended chain polyethylene or aramid fibers, or any elastic material that can withstand the desired loads and absorb energy. Alternatively, or in combination, another panel 20 may be connected to dock 14 by suitable means, so that two or more panels with their interconnecting ropes are affixed to stationary structures. As shown in FIG. 3, the plurality of panels 20 forming protective system 10 may entirely encircle vessel or other structure 12, such that opposite ends are affixed to dock 14 (or the like) by suitable attachment means. Adjacent panels 20 need not be in contact with each other, but are preferably located close to each other and are spaced apart by a desired amount.

Figure 4:
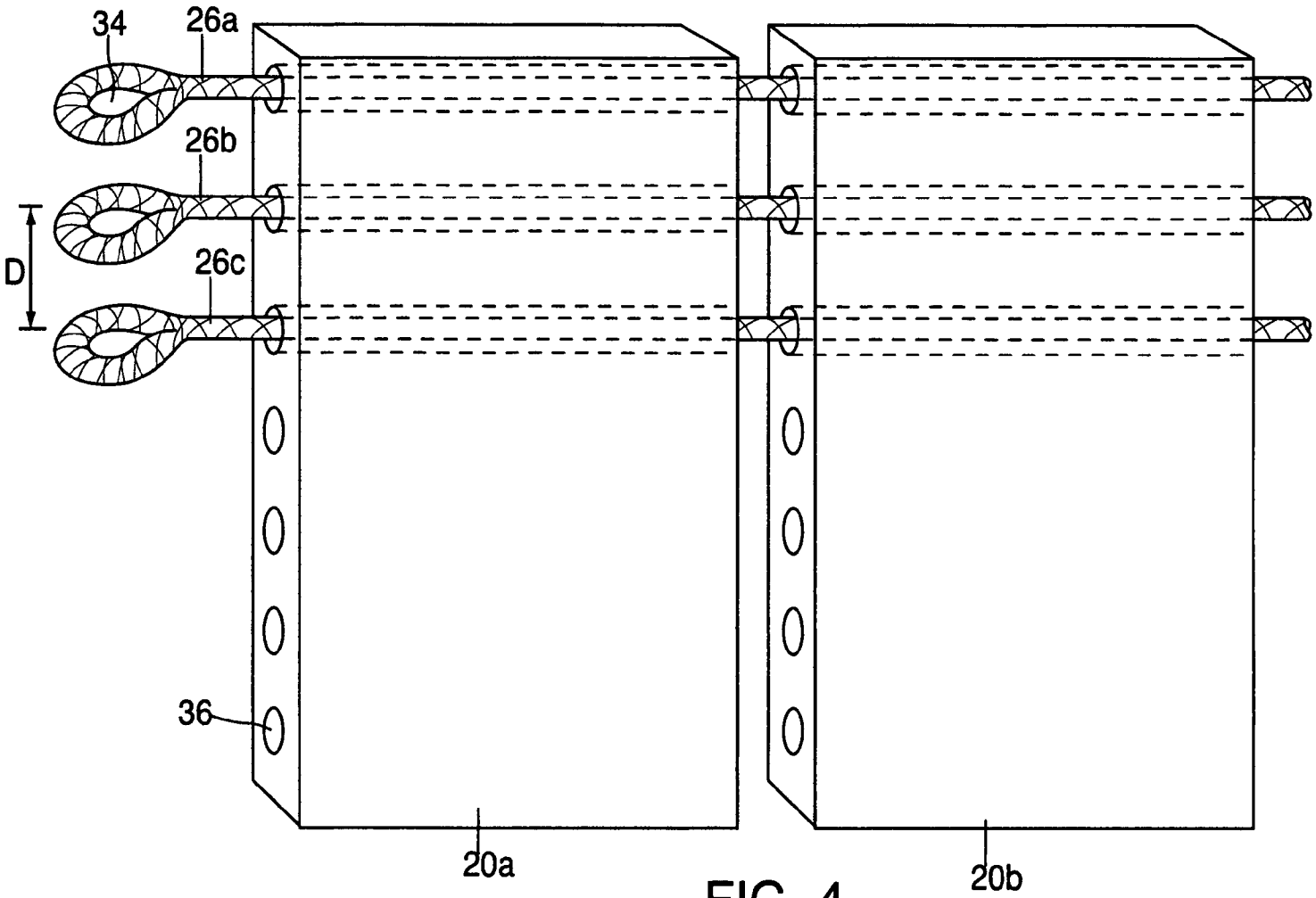
FIG. 4 is a perspective view of two floatable devices connected by ropes in accordance with the invention.

As shown in FIG. 4, adjacent panels 20*a* and 20*b* are shown. Each panel has a plurality of openings 36 through which ropes 26 extend. Openings 36 may be of any desired configuration, with preferred generally circular openings being shown in the drawing. The openings on one side of each panel are preferably aligned with the openings on the other side of the panels, and the openings in one panel are preferably aligned with the openings in the adjacent panel. Openings 36 may if desired be reinforced with a conduit, pipe or the like through which ropes 26 extend from one side of a panel to the opposite side. Although a single set of front panels are shown in FIG. 4, if desired rear panels 22 may also be provided with openings through which a second set of ropes extend, or rear panels 22 may only be interconnected by their connection to front panels 20. The panels are preferably slideable over the ropes in a horizontal direction, so that they may move with wave or water action.

At least two ropes extend through openings 36 per panel. For illustration purposes, three such ropes (26*a*, 26*b* and 26*c*) are shown in FIG. 4. The ends of these ropes may be provided with spliced eyes 34 or other connecting devices such that the ropes may be connected to a suitable structure (e.g., a concrete or other post or the like positioned on dock 14). It is also possible to configure the ropes in an endless roundsling construction in order to provide for quicker, easier installation. Alternatively or in combination, the ropes may be directly connected to one or more of the mooring lines 28, such as being attached adjacent to one or more panels 20. Preferably, the system of the invention includes at least about 4 ropes which are vertically spaced apart, more preferably at least about 8 ropes, and most preferably at least about 16 ropes, with a like number of openings 36.

Figure 5:
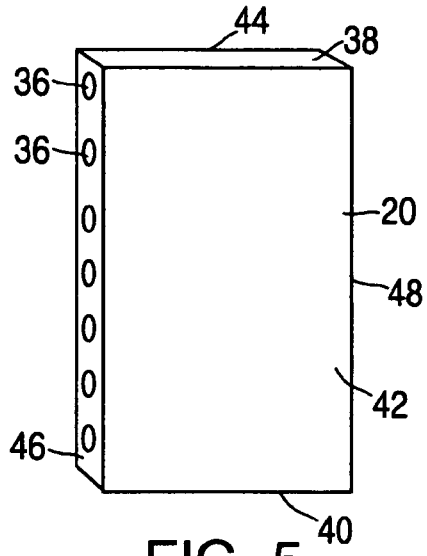
FIG. 5 is a perspective view of one floatable device used in the invention.

Each of panels 20*a* and 20*b* may have a generally rectangular shape as illustrated in FIG. 5, with the panels having a top 38, a bottom 40, front section 42, back section 44, and side sections 46 and 48. Returning to FIG. 4, each of openings 36 and hence ropes 26 extends in a generally horizontal direction which typically is parallel to waterline 16. Ropes 26*a*, 26*b* and 26*c* are generally parallel to each other along such horizontal direction and are vertically spaced from each other by a predetermined maximum distance D. In accordance with this invention, each pair of ropes are spaced apart in a generally vertical direction of a distance not exceeding about 12 inches (30.5 cm). Preferably, adjacent ropes are spaced apart a distance not exceeding about 10 inches (25.4 cm), and more preferably a distance not exceeding about 8 inches (20.3 cm). Preferably all of the ropes in the system are spaced apart by the specified distance.

Although it is possible to have many ropes which are spaced very close to each other, the cost of the protective system would substantially increase. However, a plurality of smaller diameter ropes are preferred over a lesser amount of larger diameter ropes. The number, diameter and spacing of ropes 26 are selected so that the system is designed to withstand a particular impact force. Likewise, the ropes may be of the same or different diameters, as well as constructions and fiber materials. However, it is preferred that all of the ropes are substantially similar.

Figure 7:
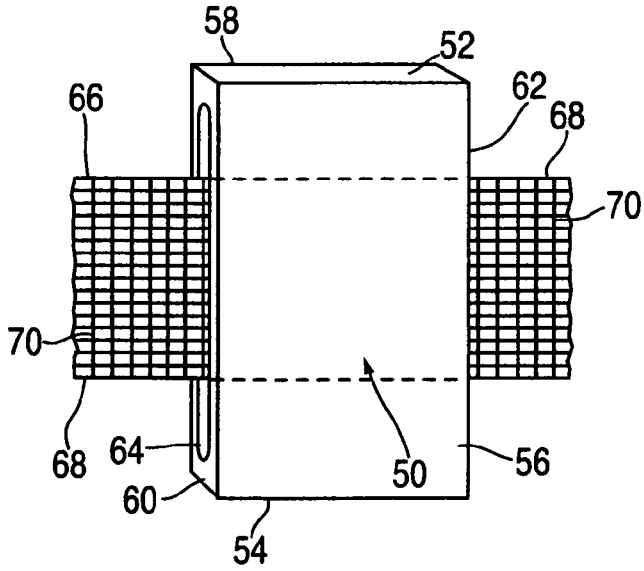
FIG. 7 is a perspective view of an alternate form of the floatable device with netting utilized in this invention.

Ropes (or cables) 26 are one form of a fibrous network, with the fibers comprising high tenacity fibers as is more fully disclosed below. An alternate form of a fibrous network is shown in FIG. 7. Alternate panel 50 likewise has a generally rectangular shape and may be formed from a similar material that forms panels 20. Panel 50 has a top 52, a bottom 54, a front 56, a back 58, and sides 60 and 62. An elongated slot 64 extends between sides 60, 62. Slot 64 is configured to receive a netting or fabric 66. Netting 66 likewise extends in a generally horizontal direction and is formed from one group of fibers 68 that extend in such generally horizontal direction and a second group of fibers 70 that extends in a direction at angles to the direction of fibers 68, more preferably generally perpendicular to the direction of fibers 68. At least the group of fibers 68 comprise high tenacity fibers, but preferably both groups 68 and 70 comprise high tenacity fibers. The groups of fibers 68 extend generally parallel to each other, and adjacent groups of fibers 68 are vertically spaced apart by a maximum of about 12 inches (30.5 cm). Adjacent pairs of groups of fibers 68 are preferably spaced more closely than adjacent ropes shown in FIG. 4. Preferably, adjacent groups of fibers 68 are vertically spaced apart by a distance not exceeding about 6 inches (15.2 cm), more preferably a distance not exceeding about 2 inches (5.1 cm).

It should be pointed out that ropes 26 need not extend through the inside of panels 20. For example, either the front or back portions of panels 20, or both, may be provided with external supporting means which engages ropes 26. Such external supporting means can be in the form of at least one, and preferably a plurality of, vertical column of hooks that can be integrally molded to panel 20, with the hooks being vertically spaced apart by a predetermined distance such that ropes 26 are spaced apart by the desired distance. The hooks provide support for ropes 26. Another form of external supporting means can be a series of slots or channels formed in one or both of the front and back surfaces of panels 20, with the channels adapted to receive the plurality of ropes 26. Again, the channels are spaced apart by the desired distance to ensure that ropes 26 are vertically spaced apart by the desired to distance.

Besides ropes and netting mentioned above, the fibrous networks may alternatively be formed from non-woven straps or webbing, unidirectionally oriented fiber tapes, woven straps, open mesh fabric, and the like. Examples of such unidirectionally oriented fiber tapes are disclosed, for example, in U.S. Pat. No. 6,642,159 to Bhatnagar et al., the disclosure of which is expressly incorporated herein by reference to the extent that it is not inconsistent herewith. Such unidirectionally oriented fiber tapes, as well as any of the other foregoing fibrous networks, may include a matrix resin.

When ropes are used as the fibrous networks, they may be of any suitable construction, such as braided ropes, twisted ropes, wire-lay ropes, parallel core ropes, and the like. Preferably the ropes are braided ropes. The ropes may be of any suitable diameter and may be formed in any suitable manner from the desired fibers and/or yarns. In general, the diameter of ropes 26 or the thickness of any other form of fibrous network does not exceed about 3 inches (7.6 cm). The diameter of ropes 26 may range, for example, from about 1/16 to about 3 inches (0.16 to 7.6 cm), more preferably from about 1/4 to about 2 inches (0.64 to 5.1 cm), and most preferably from about 1/2 to about 1.5 inches (1.27 to 3.8 cm). These ranges likewise apply to the thickness of any other form of fibrous network. Each of the ropes 26 may have the same or different diameter, but preferably they each have approximately the same diameter.

For example, in forming a braided rope a conventional braiding machine may be employed which has a plurality of yarn bobbins. As is known in the art, as the bobbins move about, the yarns are woven over and under each other and are eventually collected on a take-up reel. Details of braiding machines and the formation of ropes therefrom are known in the art and are therefore not disclosed in detail herein. Ropes which include yarns of extended chain polyethylene fibers are disclosed, for example, in U.S. Pat. Nos. 5,901,632; 5,931,076 and 6,945,153.

The yarns that form ropes 26 or other fibrous networks of the invention may be of any suitable denier. For example, the yarns may have a denier of from about 50 to about 5000, and more preferably, from about 650 to about 3000.

In accordance with this invention, ropes 26 or other fibrous networks comprise high tenacity fibers. As used herein, the term "high tenacity fibers" means fibers which have tenacities equal to or greater than about 7 g/d. Preferably, these fibers have initial tensile moduli of at least about 50 g/d (more preferably at least about 150 g/d), and energies-to-break of at least about 8 J/g as measured by ASTM D2256. As used herein, the terms "initial tensile modulus", "tensile modulus" and "modulus" mean the modulus of elasticity as measured by ASTM 2256 for a yarn.

Preferably, the high tenacity fibers have tenacities equal to or greater than about 10 g/d, more preferably equal to or greater than about 16 g/d, even more preferably equal to or greater than about 22 g/d, and most preferably equal to or greater than about 28 g/d.

High tenacity or high strength fibers useful in the fibrous networks of the invention include highly oriented high molecular weight polyolefin fibers, particularly high modulus polyethylene fibers (also known as extended chain polyethylene fibers) and polypropylene fibers; aramid fibers; polybenzazole fibers such as polybenzoxazole (PBO) and polybenzothiazole (PBT); polyvinyl alcohol fibers; polyacrylonitrile fibers; liquid crystal copolyester fibers; glass fibers; carbon fibers; basalt or other mineral fibers, as well as rigid rod polymer fibers, nylon fibers, polyester fibers, and similar fibers, as well as mixtures and blends thereof. Preferred high strength fibers useful in this invention include polyolefin fibers, aramid fibers and polybenzazole fibers, and mixtures and blends thereof. Most preferred are high molecular weight polyethylene fibers as these fibers are lighter than water and are unaffected by exposure to water.

U.S. Pat. No. 4,457,985 generally discusses such high molecular weight polyethylene and polypropylene fibers, and the disclosure of this patent is hereby incorporated by reference to the extent that it is not inconsistent herewith. In the case of polyethylene, suitable fibers are those of weight average molecular weight of at least about 150,000, preferably at least about one million and more preferably between about two million and about five million. Such high molecular weight polyethylene fibers may be spun in solution (see U.S. Pat. No. 4,137,394 and U.S. Pat. No. 4,356,138), or a filament spun from a solution to form a gel structure (see U.S. Pat. No. 4,413,110, German Off. No. 3,004,699 and GB Patent No. 2051667), or the polyethylene fibers may be produced by a rolling and drawing process (see U.S. Pat. No. 5,702,657). As used herein, the term polyethylene means a predominantly linear polyethylene material that may contain minor amounts of chain branching or comonomers, generally not exceeding 5 modifying units per 100 main chain carbon atoms, and that may also contain admixed therewith not more than about 50 wt % of one or more polymeric additives such as alkene-l-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated.

High tenacity polyethylene fibers are preferred and these are available, for example, under the trademark SPECTRA® fibers from Honeywell International Inc. of Morristown, N.J., U.S.A.

Depending upon the formation technique, the draw ratio and temperatures, and other conditions, a variety of properties can be imparted to these fibers. The tenacity of the polyethylene fibers is at least about 7 g/d, preferably at least about 15 g/d, more preferably at least about 20 g/d, still more preferably at least about 25 g/d and most preferably at least about 30 g/d. Similarly, the initial tensile modulus of the fibers, as measured by an Instron tensile testing machine, is preferably at least about 300 g/d, more preferably at least about 500 g/d, still more preferably at least about 1,000 g/d and most preferably at least about 1,200 g/d. These highest values for initial tensile modulus and tenacity are generally obtainable only by employing solution grown or gel spinning processes. Many of the filaments have melting points higher than the melting point of the polymer from which they were formed. Thus, for example, high molecular weight polyethylene of about 150,000, about one million and about two million molecular weight generally have melting points in the bulk of 138° C. The highly oriented polyethylene filaments made of these materials have melting points of from about 7° C. to about 13° C. higher. Thus, a slight increase in melting point reflects the crystalline perfection and higher crystalline orientation of the filaments as compared to the bulk polymer.

Similarly, highly oriented high molecular weight polypropylene fibers of weight average molecular weight at least about 200,000, preferably at least about one million and more preferably at least about two million may be used. Such extended chain polypropylene may be formed into reasonably well oriented filaments by the techniques prescribed in the various references referred to above, and especially by the technique of U.S. Pat. No. 4,413,110. Since polypropylene is a much less crystalline material than polyethylene and contains pendant methyl groups, tenacity values achievable with polypropylene are generally substantially lower than the corresponding values for polyethylene. Accordingly, a suitable tenacity is preferably at least about 8 g/d, more preferably at least about 11 g/d. The initial tensile modulus for polypropylene is preferably at least about 160 g/d, more preferably at least about 200 g/d. The melting point of the polypropylene is generally raised several degrees by the orientation process, such that the polypropylene filament preferably has a main melting point of at least 168° C., more preferably at least 170° C. The particularly preferred ranges for the above described parameters can advantageously provide improved performance in the final article. Employing fibers having a weight average molecular weight of at least about 200,000 coupled with the preferred ranges for the above-described parameters (modulus and tenacity) can provide advantageously improved performance in the final article.

In the case of aramid fibers, suitable fibers formed from aromatic polyamides are described in U.S. Pat. No. 3,671,542, which is incorporated herein by reference to the extent not inconsistent herewith. Preferred aramid fibers will have a tenacity of at least about 20 g/d, an initial tensile modulus of at least about 400 g/d and an energy-to-break at least about 8 J/g, and particularly preferred aramid fibers will have a tenacity of at least about 20 g/d and an energy-to-break of at least about 20 J/g. Most preferred aramid fibers will have a tenacity of at least about 20 g/d, a modulus of at least about 900 g/d and an energy-to-break of at least about 30 J/g. For example, poly(p-phenylene terephthalamide) filaments which have moderately high moduli and tenacity values are particularly useful in forming ballistic resistant composites. Examples are Twaron® T2000 from Teijin which has a denier of 1000. Other examples are Kevlar® 29 which has 500 g/d and 22 g/d as values of initial tensile modulus and tenacity, respectively, as well as Kevlar® 129 and KM2 which are available in 400, 640 and 840 deniers from du Pont. Aramid fibers from other manufacturers can also be used in this invention. Copolymers of poly(p-phenylene terephthalamide) may also be used, such as co-poly(p-phenylene terephthalamide 3,4' oxydiphenylene terephthalamide). Also useful in the practice of this invention are poly(m-phenylene isophthalamide) fibers produced commercially by du Pont under the trade name Nomex®.

High molecular weight polyvinyl alcohol (PV-OH) fibers having high tensile modulus are described in U.S. Pat. No. 4,440,711 to Kwon et al., which is hereby incorporated by reference to the extent it is not inconsistent herewith. High molecular weight PV-OH fibers should have a weight average molecular weight of at least about 200,000. Particularly useful PV-OH fibers should have a modulus of at least about 300 g/d, a tenacity preferably at least about 10 g/d, more preferably at least about 14 g/d and most preferably at least about 17 g/d, and an energy to break of at least about 8 J/g. PV-OH fiber having such properties can be produced, for example, by the process disclosed in U.S. Pat. No. 4,599,267.

In the case of polyacrylonitrile (PAN), the PAN fiber should have a weight average molecular weight of at least about 400,000. Particularly useful PAN fiber should have a tenacity of preferably at least about 10 g/d and an energy to break of at least about 8 J/g. PAN fiber having a molecular weight of at least about 400,000, a tenacity of at least about 15 to 20 g/d and an energy to break of at least about 8 J/g is most useful; and such fibers are disclosed, for example, in U.S. Pat. No. 4,535,027.

Suitable liquid crystal copolyester fibers for the practice of this invention are disclosed, for example, in U.S. Pat. Nos. 3,975,487; 4,118,372 and 4,161,470.

Suitable polybenzazole fibers for the practice of this invention are disclosed, for example, in U.S. Pat. Nos. 5,286,833, 5,296,185, 5,356,584, 5,534,205 and 6,040,050. Preferably, the polybenzazole fibers are Zylon® brand fibers from to Toyobo Co.

Rigid rod fibers are disclosed, for example, in U.S. Pat. Nos. 5,674,969, 5,939,553, 5,945,537 and 6,040,478. Such fibers are available under the designation M5® fibers from Magellan Systems International.

In the case of extended chain polyethylene fibers, preparation and drawing of gel-spun polyethylene fibers are described in various publications, including U.S. Pat. Nos. 4,413,110; 4,430,383; 4,436,689; 4,536,536; 4,545,950; 4,551,296; 4,612,148; 4,617,233; 4,663,101; 5,032,338; 5,246,657; 5,286,435; 5,342,567; 5,578,374; 5,736,244; 5,741,451; 5,958,582; 5,972,498; 6,448,359; 6,969,553 and U.S. patent application publication 2005/0093200, the disclosures of which are expressly incorporated herein by reference to the extent not incompatible herewith.

For the purposes of the present invention, a fiber is an elongate body the length dimension of which is much greater that the transverse dimensions of width and thickness. Accordingly, the term fiber includes monofilament, multifilament, ribbon, strip, staple and other forms of chopped, cut or discontinuous fiber and the like having regular or irregular cross-section. Fibers may also be in the form of ribbon, strip or split film or tape. The term "fiber" includes a plurality of any of the foregoing or a combination thereof. A yarn is a continuous strand comprised of many fibers or filaments.

The cross-sections of fibers useful herein may vary widely. They may be circular, flat or oblong in cross-section. They may also be of irregular or regular multi-lobal cross-section having one or more regular or irregular lobes projecting from the linear or longitudinal axis of the fibers. It is preferred that the fibers be of substantially circular, flat or oblong cross-section, most preferably circular.

The fibrous networks of this invention preferably comprise at least 50 percent by weight of the high tenacity fibers, more preferably at least about 75 percent by weight and most preferably substantially all fibers in the fibrous networks comprise the high tenacity fibers.

Other types of fibers may be blended in with the high tenacity fibers to provide desirable properties. One example of such fibers are fluoropolymer fibers formed, for example, from polytetrafluoroethylene (preferably expanded polytetrafluoroethylene), polychorotrifluoroethylene (both homopolymers and copolymers (including terpolymers)), polyvinyl fluoride, polyvinylidene fluoride, ethylene-tetrafluoroethylene copolymers, ethylene-chlorotrifluorethylene copolymers, fluorinated ethylene-propylene copolymers, perfluoroalkoxy polymer, and the like, as well as blends of two or more of the foregoing. Examples of the foregoing are disclosed, for example, in U.S. patent application Ser. No. 11/481,872, filed Jul. 6, 2006, the disclosure of which is expressly incorporated herein by reference to the extent that it is not inconsistent herewith.

The fibrous networks may be coated with one or more resins or coating compositions as desired to achieve desirable properties. Individual fibers or yarns, or the formed rope, may be coated with the desired material. For example, a coating of a mixture of an amino functional silicone resin and a neutralized low molecular weight polyethylene may be used, such as those disclosed in U.S. patent application Ser. No. 11/361,180, filed Feb. 24, 2006, the disclosure of which is expressly incorporated herein by reference to the extent that it is not inconsistent herewith.

Preferably each of the ropes or other fibrous networks has a minimum breaking strength of at least about 31,000 pounds (14,090 kg), and more preferably at least about 165,000 pounds (75,000 kg), as tested by ASTM D-4268.

The plurality of fibrous networks are utilized in a protective system that is designed to protect structures from different threat levels. For example, protective system 10 may be designed to provide protection against an impact force of at least about 300,000 ft-lbs (406,745 N-m), more preferably an impact force of at least about 600,000 ft-lbs (813,491 N-m).

Without being bound to any specific theory, it is believed that the close spacing of the fibrous networks formed from the high tenacity fibers permits the overall structure to load level against the impact force. The panels 20 themselves are not designed to be the structure which repels the impact force. Rather, it is the plurality of high tenacity fibrous networks, preferably in the form of ropes, that are designed to absorb the impact force. When a watercraft threatens vessel 12, it is impeded by the plurality of high tenacity fibrous networks. The group of panels with their interconnecting high tenacity fibrous networks is designed to be displaced towards vessel 12 when impacted by a watercraft or the like, but the fibrous networks dissipate the impact energy of the intruding watercraft, and the firm connection of the group of fibrous networks through panels 20 to rigid structures (e.g., anchors or docks) prevents the system from being dislocated too close to the vessel that is being protected. As such, the intruding boat is stopped at a safe distance from the ship or other structure that is being protected, such that a terrorist attack can be minimized.

In one embodiment, there is at least one rope 26 or other fibrous network that extends above waterline 16 and at least one rope 26 or other fibrous network that extends below waterline 16.

System 10 may be provided with one or more gates to facilitate entry of vessel 12 to a dock or the like. In addition, one or more sensing devices (not shown) may be employed along the length of the plurality of panels 20 in order to detect intrusion by boats, trespassers, divers or other means. Such sensing devices include, without limitation, optical fibers that may extend either parallel to ropes 26 or may be a component of such ropes. In addition, a diver net (not shown) may be employed beneath the group of panels 20 to further protect vessel 12 from attacks.

In one exemplary embodiment of the invention, panels 20 are formed from high density polyethylene plastic with a generally rectangular shape and a hollow interior. Such panels have dimensions of 8 feet (2.4 meters) high, 3 feet (0.9 meters) wide and 1 foot (0.3 meters) thick, and weigh approximately 60 lbs (27.2 kg). Openings 36 in the sides of the panels are circular in shape having a diameter of about 3 inches (7.6 cm). Openings 36 are spaced apart a distance of 10 inches (25.4 cm), measured from the center of each opening. A total of 8 openings are provided. Ropes 26 which extend through openings 36 are formed from SPECTRA® extended chain polyethylene fiber. The ropes are braided ropes formed from 4800 denier SPECTRA® 900 yarn, with the yarns twisted together and braided into the desired rope diameter. Each rope 26 has a diameter of 1 inch (2.54 cm). A total of 8 ropes are employed and they are spaced approximately 10 inches (25.4 cm) apart in the vertical dimension. Each rope has a minimum breaking strength of 110,000 pounds (50,000 kg).

Panels 20 and interconnecting ropes 26 are deployed about a ship to be protected. Approximately 75% of the height of the panels extend above the waterline. The panels are deployed at a distance of about 200 feet (61 meters) from the ship to be protected. Several of the panels are attached by mooring lines to anchors on the seabed. The system 10 is designed to withstand an impact force of about 600,000 ft-lbs (813,491 N-m).

By utilizing a plurality of ropes or the like, several advantages are attendant with the system of this invention. These advantages include a lighter weight system that can be moved from location to location should it be necessary, a system that is less costly to deploy, a system that requires less maintenance than conventional systems due to the inert nature of the high tenacity synthetic fibrous networks, and a system that is adaptable to the threat level by changing the diameters of the ropes or other fibrous networks. By using braided ropes formed of high tenacity fibers, such as extended chain polyethylene fibers, these ropes are spliceable in the field. Spliceability ensures that the ropes can be removed and/or installed in the field, thereby allowing the user to save costs by repairing the barrier on-site rather than removing the entire barrier for repair.

It can be seen that the present invention provides a protective system based on fibrous networks of high tenacity fibers which are designed to protect vessels and the like from terrorist threats from watercraft and the like. The high tenacity fibrous networks are designed to withstand the impact force of an intruding vessel or the like. The system is relatively uncomplicated, easy to manufacture and easy to deploy.

Having thus described the invention in rather full detail, it will be understood that such detail need not be strictly adhered to but that further changes and modifications may suggest themselves to one skilled in the art, all falling within the to scope of the invention as defined by the subjoined claims.

What is claimed is:

1. A system to protect structures in a marine environment from the effects of an impact force, said system comprising:

(a) a plurality of spaced apart and floatable panels, said panels being adapted to be located at a distance from said structure to be protected; and (b) a plurality of fibrous networks, said fibrous networks comprising high tenacity fibers extending in at least a generally horizontal direction, said plurality of fibrous networks being in communication with said plurality of floatable devices and interconnecting said plurality of floating devices, said plurality of fibrous networks being disposed in a generally parallel arrangement with respect to each other along said generally horizontal direction in a generally vertical plane, said plurality of fibrous networks being vertically spaced apart by a distance not exceeding about 12 inches (30.5 cm), wherein said fibrous networks comprise fibers selected from the group consisting of polyolefin fibers, aramid fibers, polybenzazole fibers, and mixtures and blends thereof, and wherein said fibers have a tenacity of at least about 7 g/d, an initial tensile modulus of at least about 50 g/d, and an energy-to-break of at least about 8 J/g as measured by ASTM D2256.

2. The system of claim 1 wherein said fibrous networks are in the form of ropes.

3. The system of claim 2 wherein said ropes are braided.

4. The system of claim 3 wherein said ropes have a diameter not exceeding about 3 inch (7.6 cm).

5. The system of claim 3 wherein said ropes have a diameter of from about ¼ to about 2 inches (about 0.64 to about 5.1 cm).

6. The system of claim 2 including at least about 8 ropes.

7. The system of claim 1 wherein said fibers have a tenacity of at least about 22 g/d.

8. The system of claim 1 wherein said ropes are vertically spaced apart a distance not exceeding about 8 inches (20.3 cm).

9. The system of claim 1 wherein said fibrous networks are vertically spaced apart a distance not exceeding about 8 inches (20.3 cm).

10. The system of claim 1 wherein said panels have a generally rectangular shape, and include a plurality of openings in the sides thereof, with said fibrous networks extending through said openings and passing from one side of said panels through the other side of said panel to communicate with an adjacent panel.

11. The system of claim 1 wherein said fibrous networks comprise a fiber netting.

12. The system of claim 11 wherein said panels have a generally rectangular shape, and include a slot on each side of said panel, with said netting extending through said slots and passing from one side of said panel through the other side of said panel to communicate with an adjacent panel.

13. The system of claim 1 wherein said fibrous networks comprise extended chain polyethylene fibers.

14. The system of claim 13 wherein said fibrous networks comprise ropes comprised of extended chain polyethylene fibers.

15. The system of claim 1 wherein said fibrous networks and/or said fibers are coated.

16. The system of claim 15 wherein said fibrous networks and/or said fibers are coated with a composition comprising an amino functional silicone resin and a neutralized low molecular weight polyethylene.

17. The system of claim 1 wherein each of said fibrous networks has a minimum breaking strength of at least about 31,300 lbs (14,090 kg).

18. The system of claim 1 wherein said panels are formed from high density polyethylene.

19. The system of claim 1 wherein said structure comprises a ship.

20. In a system to protect structures in a marine environment from the effects of an impact force, the improvement comprising:

(a) a plurality of spaced apart and floatable panels, said panels being adapted to be located at a distance from said structure to be protected; and (b) a plurality of fibrous networks, said fibrous networks comprising high tenacity fibers extending in at least a generally horizontal direction, said plurality of fibrous networks being in communication with said plurality of floatable devices and interconnecting said plurality of floating devices, said plurality of fibrous networks being disposed in a generally parallel arrangement with respect to each other along said generally horizontal direction in a generally vertical plane, said plurality of fibrous networks being vertically spaced apart by a distance not exceeding about 12 inches (30.5 cm), wherein said fibrous networks comprise fibers selected from the group consisting of polyolefin fibers, aramid fibers, polybenzazole fibers, and mixtures and blends thereof, and wherein said fibers have a tenacity at least about 7 g/d, an initial tensile modulus of at least about 50 g/d, and an energy-to-break of at least about 8 J/g as measured by ASTM D2256.

21. The system of claim 20 wherein said fibrous networks are in the form of ropes.

22. The system of claim 21 wherein said ropes have a diameter of from about 1/16 to about 3 inches (0.16 to 7.6 cm).

23. The system of claim 21 wherein said ropes are vertically spaced apart a distance not exceeding about 8 inches (20.3 cm).

24. The system of claim 20 wherein said panels have a generally rectangular shape, and include a plurality of openings in the sides thereof, with said fibrous networks extending through said openings and passing from one side of said panels through the other side of said panel to communicate with an adjacent panel.

25. The system of claim 20 wherein said fibrous networks comprise extended chain polyethylene fibers.

26. The system of claim 20 wherein each of said fibrous networks has a minimum breaking strength of at least about 31,300 lbs (14,090 kg).

27. The system of claim 20 wherein said panels are formed from high density polyethylene.

28. A system to protect structures in a marine environment from the effects of an impact force, the system comprising:

(a) a plurality of spaced apart and interconnected floatable panels, said panels being adapted to be located at a distance from said structure to be protected; said plurality of floatable devices comprising end units;

(b) a plurality of fibrous networks, said fibrous networks comprising high tenacity fibers extending in at least a generally horizontal direction, said plurality of fibrous networks being in communication with said plurality of floatable devices and interconnecting said plurality of floating devices, said plurality of fibrous networks being disposed in a generally parallel arrangement with respect to each other along said generally horizontal direction in a generally vertical plane, said plurality of fibrous networks being vertically spaced apart by a distance exceeding about 12 inches (30.5 cm); said plurality of panels including end units; and (c) means for attaching at least said end units of said plurality of floatable devices to fixed positioning means for fixing at least said end units in a desired position, wherein said fibrous networks comprise fibers selected from the group consisting of polyolefin fibers, aramid fibers, polybenzazole fibers, and mixtures and blends thereof and wherein said fibers have a tenacity at least about 7 g/d, an initial tensile modulus of at least about 50 g/d, and an energy-to-break of at least about 8 J/g as measured by ASTM D2256.

29. The system of claim 28 which is capable of protecting said structure from impact forces of at least about 300,000 ft-lbs (406,745 N-m).

30. The system of claim 29 wherein said fixed position means comprises anchors, and including at least one mooring line connecting to at least one of said end units.

31. The system of claim 28 wherein said fibrous networks are in the form of ropes.

32. The system of claim 31 wherein said ropes are vertically spaced apart a distance not exceeding about 8 inches (20.3 cm).

33. The system of claim 28 wherein said fibrous networks comprise extended chain polyethylene fibers.

34. The system of claim 28 wherein said at least one of said fibrous networks extends above a waterline and at least one of said fibrous networks extends beneath said waterline.

35. The system of claim 28 wherein said panels are formed from a plastic material.

36. The system of claim 28 wherein said plurality of fibrous networks comprise a plurality of ropes, and said panels have a generally rectangular shape and include a plurality of openings in the sides thereof, with said ropes extending through said openings and passing from one side of said panels through the other side of said panels to communicate with an adjacent panel, said ropes comprising extended chain polyethylene fibers.

37. The system of claim 36 which is capable of protecting said structure from impact forces of at least about 600,000 ft-lbs (813,491 N-m).

* * * * *